US005137488A

United States Patent [19]

Yeh

[11] Patent Number: 5,137,488

[45] Date of Patent: Aug. 11, 1992

[54] SPORTS ROD EQUIPPED WITH SOUND REPRODUCING MEANS

[76] Inventor: Peter Yeh, 6th Fl., No. 210, An Ho Rd., Taipei, Taiwan

[21] Appl. No.: 749,079

[22] Filed: Aug. 23, 1991

[51] Int. Cl.[5] ..... A63H 5/00; A63H 3/28; A63H 3/52

[52] U.S. Cl. ..... 446/397; 446/408; 446/303

[58] Field of Search ..... 446/397, 401, 404, 405, 446/408, 484, 485, 297, 302, 303; 273/67 R; 40/124.1

[56] References Cited

U.S. PATENT DOCUMENTS

| | | | |
|---|---|---|---|
| 3,394,491 | 7/1968 | Valentine | 446/397 X |
| 3,412,197 | 11/1968 | Weitzner | 446/397 X |
| 3,508,751 | 4/1970 | Meyer et al. | 446/397 X |
| 4,729,747 | 3/1988 | Yeh | 446/484 X |
| 4,791,741 | 12/1988 | Kondo | 40/124.1 |
| 4,967,321 | 10/1990 | Cimock | 446/485 X |
| 5,045,014 | 9/1991 | Harkins | 446/484 X |
| 5,049,107 | 9/1991 | DeNittis | 446/397 |
| 5,058,894 | 10/1991 | Levinn et al. | 446/397 X |

*Primary Examiner*—Robert A. Hafer
*Assistant Examiner*—D. Neal Muir
*Attorney, Agent, or Firm*—Browdy and Neimark

[57] ABSTRACT

Sports rod equipped with sound reproducer is composed mainly of a first rod case and a second rod case, both being of hollow construction and made of plastic material by injection molding. The first and the second rod cases join to form a rod-shaped body with the central portion thereof being hand grip and with both ends thereof being circularly headed. The sports rod has therein a sound reproducer, which in turn is provided with a speaker mounted on the speaker mount, and a circuit board containing thereon an integrated circuit with music or exercise commands stored programmably therein. When the switch of the sports rod is turned on, the sound reproducing device of the sports rod begins producing the sound of music or exercise commands stored in the integrated circuit thereof.

1 Claim, 2 Drawing Sheets

SPORTS ROD EQUIPPED WITH SOUND REPRODUCING MEANS

BACKGROUND OF THE INVENTION

The present invention relates to a sports and recreational equipment, and more particularly to a sports rod equipped with sound reproducing means.

The sports rod of the present invention is used mainly in sports and recreational activities, in which the act of cheering is intensively involved. The conventional sports rod of the prior art is mainly composed of a rod-shaped body with a number of colored ribbons attached thereto at one end thereof and is intended for use in sports events, dancing, cheering, etc. However, it is a rather monotonous sports and recreational equipment that often fails to help draw the attention of the participants.

SUMMARY OF THE INVENTION

It is therefore the primary objective of the present invention to provide a sports rod which is equipped with sound reproducing means and is of light and ingenious construction. Such sports rod is provided with means to produce musical melodies or sports music to entertain the users thereof and to assist the users and the participants in coordinating exercises.

It is another objective of the present invention to provide a sports rod with sound reproducing means which is small in size and light in weight and is capable of reproducing music.

In keeping with principles of the present invention, the primary objectives of the present invention are accomplished by a sports rod comprising mainly a first rod case, a second rod case, and a sound reproducing device. The first rod case of hollow construction is made of plastic material by means of injection molding and is partly cambered externally. The interior of the first rod case is provided with a battery mount and a speaker mount. The sound reproducing device is composed of a circuit board fastened securely to set columns and a speaker fixed on the speaker mount located in the first rod case. The second rod case of hollow construction is also made of plastic material by injection molding process and has a shape symmetrical to the shape of the first rod case. The first rod case and the second rod case are joined together to form a circular rod having circular ends and are provided respectively with semi-circular holes to accommodate the colored ribbons. The sound reproducing device serves to reproduce music or commands.

The foregoing features, objectives, and advantages of the present invention will be better understood by studying the following detailed description of the preferred embodiment, in conjunction with the drawings provided herein.

DETAILED DESCRIPTION OF THE PREFERRED EMBODIMENT

Figure 1:
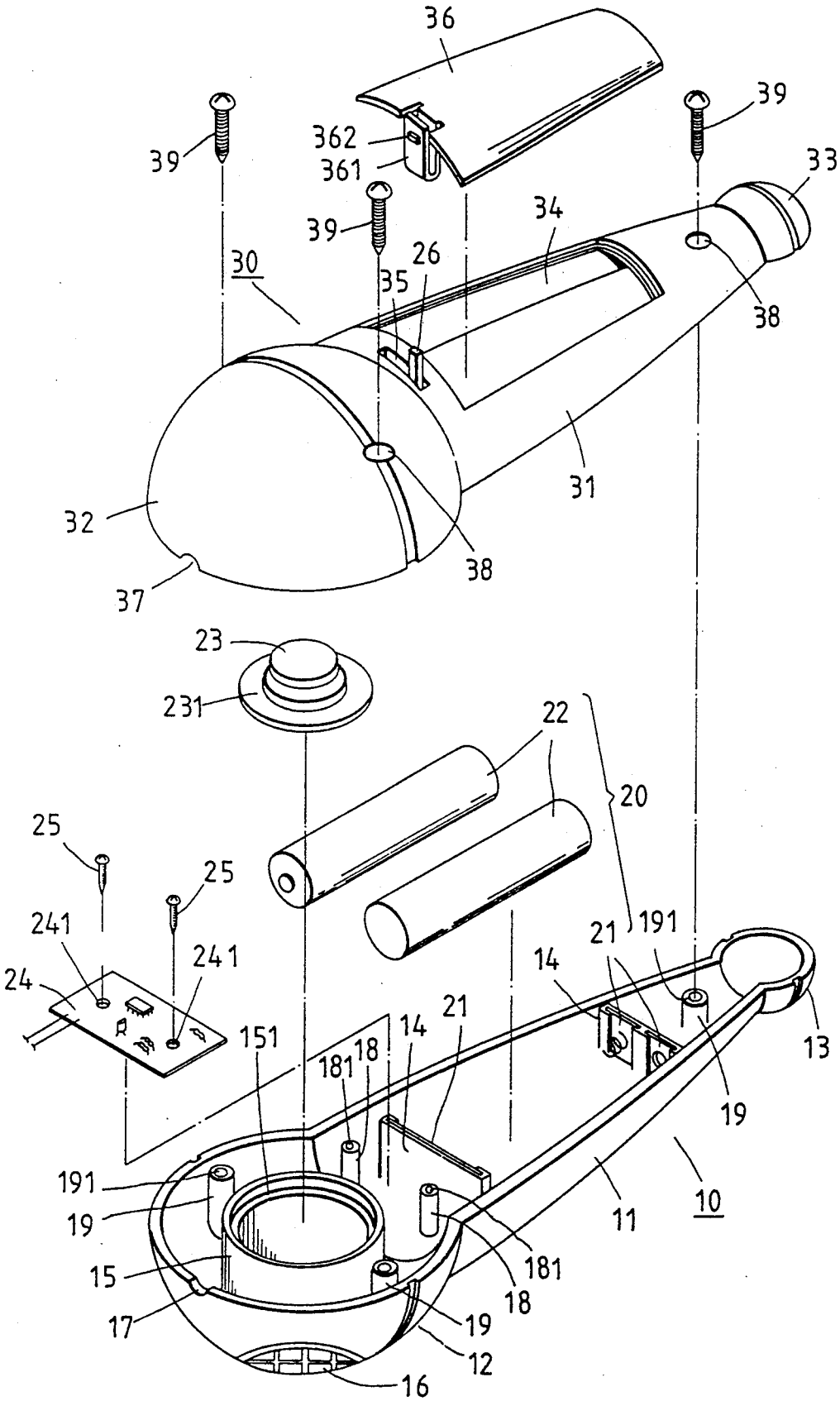
Figure 2:
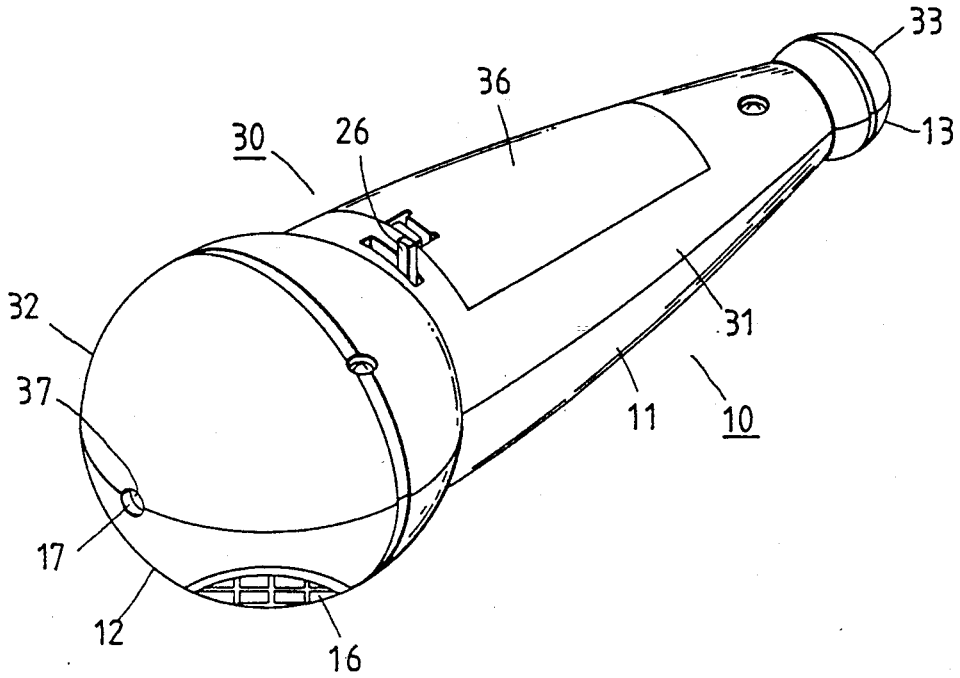
FIG. 2 shows a three-dimensional external view of a sports rod of the present invention.

Referring to FIGS. 1 and 2, the sports rod of the present invention is shown comprising a first rod case 10, a sound reproducing device 20, and a second rod case 30. The first rod case 10 of hollow construction is made of plastic material by means of injection molding and is provided with a hand grip 11, a circular head, 12, and a circular tail 13. The first rod case 10 further comprises battery mounts 14 and a tubular and circular speaker mount 15 located in the hollow interior thereof. The first rod case 10 has a surface of circular arc construction. The speaker mount 15 is composed of a ring edge 151 located at the top portion thereof, a bottom surface which is connected to a cellular sound holes 16, a semi-circular hole 17 located at the top portion of circular head 12 thereof, two set columns 18 with threaded holes 181 located at the top ends thereof, and three screw receiving columns 19 having threaded holes 191 arranged at the top ends thereof. The sound reproducing device 20 comprises conductive pieces 21, a speaker 23, and a circuit board 24. The conductive pieces 21 are respectively mounted in the battery mounts 14. The batteries 22 are seated in the space located between the conductive pieces 21. The speaker 23 consists of a disk 231, which fits into the ring edge 151 of the speaker mount 15. The circuit board 24 is made up of circuits controlling the reproduction of sound, which will be further explained later is this specification. The circuit board 24 is fastened to the two set columns 18 by means of two crews 25 which engage with two threaded holes 181 of the two set columns 18 via two screw holes 241 of the circuit board 24. A switch 26 is fastened to the second rod case 30, which is of hollow construction and is made of plastic material by means of injection molding. The second rod case 30 is symmetrical in shape to the first rod case 10 and is provided with a hand grip 31, a circular head 32, and a circular tail 33. The hand grip 31 comprises therein a battery cover hole 34 and a switch hole 35. The battery cover 36 is made of plastic material by injection molding and is composed of a U-shaped elastic piece 361 having a retaining point 362 located at the front side thereof so as to ensure that the battery cover 36 remains securely in place in the battery cover hole 34. The switch 26 is arranged securely in the switch hole 35. The semi-circular hole 37 of the second rod case 30 serves to form a circular hole in conjunction with the semi-circular hole 17 of the first rod case 10. The second rod case 30 is further provided with the three screw holes 38 located on the same surface thereof, through which three screws 39 pass to engage with the three threaded holes 191 of the screw receiving columns 19 so that the first rod case 10 and the second rod case 30 are coupled securely.

Figure 3:
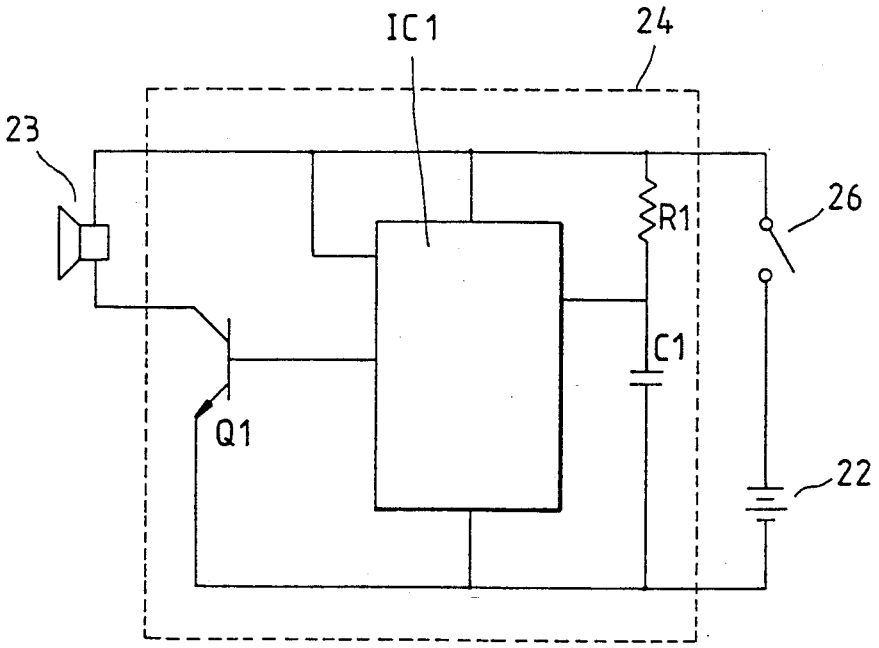
FIG. 3 shows a circuitry of sound reproducing device of the preferred embodiment of the present invention.

As shown in FIG. 3, the circuit board 24 of the sound reproducing device 20 comprises thereon an integrated circuit designated as IC1, which can be programmed to store music or exercise commands. Through the coordination of electrical resistance R1, electrical capacity C1, and the transistor Q1, the speaker 23 is capable of sounding the music or the exercise command stored in the integrated circuit IC1 when the switch 26 is turned on.

In addition, the colored ribbons (not shown in the drawings) can be placed and held in the semi-circular holes 17 and 37 to enhance the esthetic effect of the sports rod of the present invention. Of course, this must be done before the first and the second rod cases 10 and 30 are screwed together.

The sports rod of the present invention is designed to be very handy and easy to use. As soon as the switch 26 is turned on, the sound reproducing device 20 begins producing the sound of music or exercise commands stored programmably in the integrated circuit IC1. The sports rod of the present invention is therefore an ideal sports and recreational adjunct or ornament for use by an individual exerciser, a leader of the group exercise, a cheer leader, and the like.

The embodiment of the present invention described above is to be considered in all respects as merely an illustration of principles of the present invention. Accordingly, the present invention is to be limited only by the scope of the hereinafter appended claims.

What I claim is:

1. A sports rod equipped with sound reproducing means comprising:

a hollow plastic housing made by injection molding, said hollow plastic housing comprising:

a cylindrical handle having a circular cross section transverse to the long axis of the handle which changes in diameter from a first end of said handle to a second end of said handle, a first circular hollow bulb integrally formed at said first end of said handle, a second circular hollow bulb integrally formed at said second end of said handle, said first circular hollow bulb being substantially larger than said second circular bulb, a hole in said first circular hollow bulb on the longitudinal axis of said housing for engaging colored ribbons, said housing formed by two symmetrical halves detachably engaged on a plane through the longitudinal axis of said housing, a first half of said two symmetrical halves having a cylindrical speaker mount integrally formed in a first half of said first circular hollow bulb, cellular sound holes on said first half of said first circular bulb corresponding to said speaker mount, said first half of said two symmetrical halves having battery mounts in a first half of said hollow handle, sound reproducing means for playing on command a preselected acoustical program permanently inscribed in a circuit board contained in said housing, said sound reproducing means comprising:

conductive pieces mounted on said battery mounts, batteries seated between said battery mounts, a speaker having a disk portion fitting into said speaker mount, and a circuit board secured to said first half of said two symmetrical halves, said circuit board provided with an integrated circuit having a preselected acoustical program permanently inscribed therein, battery access means for replacement of said two batteries and switch means for actuating said sound reproducing means located on a second half of said two symmetrical halves, wherein said preselected acoustical program is played on command by participants at appropriate times at sports events to assist in conducting the festivities.

* * * * *